US012503849B2

(12) United States Patent
Gu et al.

(10) Patent No.: US 12,503,849 B2
(45) Date of Patent: Dec. 23, 2025

(54) WALL SYSTEM WITH INFILLED CROSS-LAMINATED TIMBER PANEL

(71) Applicants: Jianzhong Gu, Kamloops (CA); Hengtong Gu, Kamloops (CA)

(72) Inventors: Jianzhong Gu, Kamloops (CA); Hengtong Gu, Kamloops (CA)

(73) Assignee: Jianzhong Gu, Kamloops (CA)

( * ) Notice: Subject to any disclaimer, the term of this patent is extended or adjusted under 35 U.S.C. 154(b) by 176 days.

(21) Appl. No.: 18/502,101

(22) Filed: Nov. 6, 2023

(65) Prior Publication Data

US 2025/0146274 A1 May 8, 2025

(51) Int. Cl.
*E04B 2/72* (2006.01)

(52) U.S. Cl.
CPC ..... *E04B 2/721* (2013.01)

(58) Field of Classification Search
CPC ... E04B 2/72; E04B 2/721; E04B 2/58; E04B 2/70
See application file for complete search history.

(56) References Cited

U.S. PATENT DOCUMENTS 8,225,562 B2 * 7/2012 Parker ..... E06B 3/6604 52/311.2
8,511,014 B2 * 8/2013 Delforte ..... E04F 19/06 52/489.1
8,756,883 B2 * 6/2014 Glass ..... E06B 5/025 52/745.16
8,991,127 B2 * 3/2015 Todd ..... E04F 13/072 52/489.1
9,045,936 B2 * 6/2015 Cho ..... E06B 9/02
9,359,771 B1 * 6/2016 Delforte ..... E04F 13/083
12,264,534 B2 * 4/2025 Welage ..... E06B 5/113
12,331,510 B2 * 6/2025 Sherman ..... E04F 13/0875
2012/0297706 A1 * 11/2012 Bourdon ..... E06B 3/28 52/204.593
2015/0052815 A1 * 2/2015 Arteta Loredo ..... E06B 7/086 49/81.1
2017/0298627 A1 * 10/2017 VanHoose ..... E04C 2/288
2023/0350260 A1 * 11/2023 Martinson ..... B32B 17/10513
2023/0364886 A1 * 11/2023 Hauptman ..... B32B 37/12

* cited by examiner

*Primary Examiner* — Chi Q Nguyen

(57) ABSTRACT

A wall system with two columns, two beams, one infilled cross-laminated timber panel, steel angles and associated fasteners, is presented. The columns and beams form four sides of a planar frame. Each of the columns and the beams is configured to connect to a steel member with fasteners protruding inside of the planar frame to receive the infilled cross-laminated timber panel. The steel member connects to the panel with at least one fastener. Each edge of the panel is configured to have a space from the inside face of the frame, leaving an all-around gap between the panel and the surrounding frame members. The infilled panel is essentially suspended inside the frame by the steel member and their associated fasteners. The gap between the frame and the infilled panel allows the panel to rotate and translate when the frame deforms to a parallelogram shape under lateral loadings.

10 Claims, 5 Drawing Sheets

WALL SYSTEM WITH INFILLED CROSS-LAMINATED TIMBER PANEL

BACKGROUND OF THE INVENTION

Cross laminated timber (CLT) panels are typically pre-manufactured away from the construction site and installed on site with fasteners. CLT panels can be used to build shear walls to provide lateral stability under wind and earthquake loadings. As CLT panels are relatively strong in their strength and stiffness, they do not bend, distort or deform much under lateral loadings. As a result, a traditional CLT panel shear wall typically develops a rocking mechanism under lateral loadings. The rocking mechanism commonly relies on angle brackets or other connections at the lower corners of the CLT panel in order to hold the panel down to other structural members. The potential failure of the angle brackets or other connections would cause the CLT panel to rock, or even overturn in extreme situations, which would cause the CLT panel shear wall to collapse in a disastrous mode. This potential failure mode exists in all walls built with other rigid panels, including precast concrete panels, which currently limits their use to low-rise buildings only. For mid-rise and high-rise buildings, walls built with rigid panels including CLT and precast concrete panels demand new configurations with safe mechanisms under lateral loadings.

SUMMARY OF THE INVENTION

The present invention provides a wall system consisting of a frame, a suspended-infilled cross-laminated timber (CLT) panel, steel angles and fasteners, arranged in such a way that the wall system develops a shear mechanism under lateral loadings. The design minimizes the unfavorable rocking mechanism of the rigid panels used in traditional construction and thus reduces the damage to the building that might exhibit during an earthquake or a hurricane. It permits buildings to be built with rigid panels such as CLT in mid-rise and high-rise buildings to greater heights than the current practice.

The present invention has two columns spaced apart horizontally and two beams spaced apart vertically. The two columns and two beams form four sides of a planar frame in the vertical plane. The two columns and the two beams are made of either solid sawn lumber, engineered lumber, steel or precast concrete. The two columns and the two beams have the same or similar width across the plane of the planar frame. Each member of the two columns and the two beams has one steel angle connected on the inside face toward the centre of the planar frame. The each member of the columns and the beams is configured to connect to one leg of the steel angle with either screws, bolts, welds or cast-in-concrete studs, depending on the material of the columns and the beams. The other leg of the steel angle is configured to connect to the flat side of the infilled panel with at least one fastener. The CLT panel is infilled inside the planar frame. The infilled CLT panel does not contact directly with any of the four inside faces of the planar frame. The infilled panel connects to the each member of the planar frame through the steel angles and associated fasteners. Thus, a gap between the inside face of the planar frame and the edge side of the infilled CLT panel is formed in order to allow the infilled panel to rotate and translate inside the planar frame, and to allow for the member thickness of the steel angles and related fasteners. Overall, the infilled CLT panel is suspended inside the planar frame through the steel angles and their associated fasteners.

The location of the aforementioned steel angles can be positioned such that the finished surface of the steel angles and the fasteners is flush against the flat side of the infilled rigid panel.

The aforementioned steel angle may be replaced by a steel plate, either flat or bended to suit the finished surfaces of the planar frame and the infilled panel. The steel plate is connected to the outside of the each member of the columns and beams with either screws, bolts, welds or cast-in-concrete studs, depending on the materials of these members.

BRIEF DESCRIPTION OF DRAWINGS

The foregoing summary and the following detailed description should be read in conjunction with the appended drawings. These drawings show different embodiments of the present invention. It should be understood, however, that the teachings are not limited to the embodiments shown.

DETAILED DESCRIPTION OF THE INVENTION

A wall system consisting of a planar frame, an infilled CLT panel, steel members and fasteners, is provided. The infilled CLT panel is suspended inside the frame with fasteners. The gap between the infilled CLT panel and the frame allows the CLT panel to rotate and translate when the frame deforms into a parallelogram shape under lateral loadings. The fasteners connected through steel members between the frame and the CLT panel bend and deform under the loadings. The bending and deformation of the fasteners dissipate energy during the racking behavior of the frame. Therefore, the wall system exhibits a ductile behavior under lateral loadings. The wall system provides a safe structural solution under wind and earthquake loadings.

Figure 1:
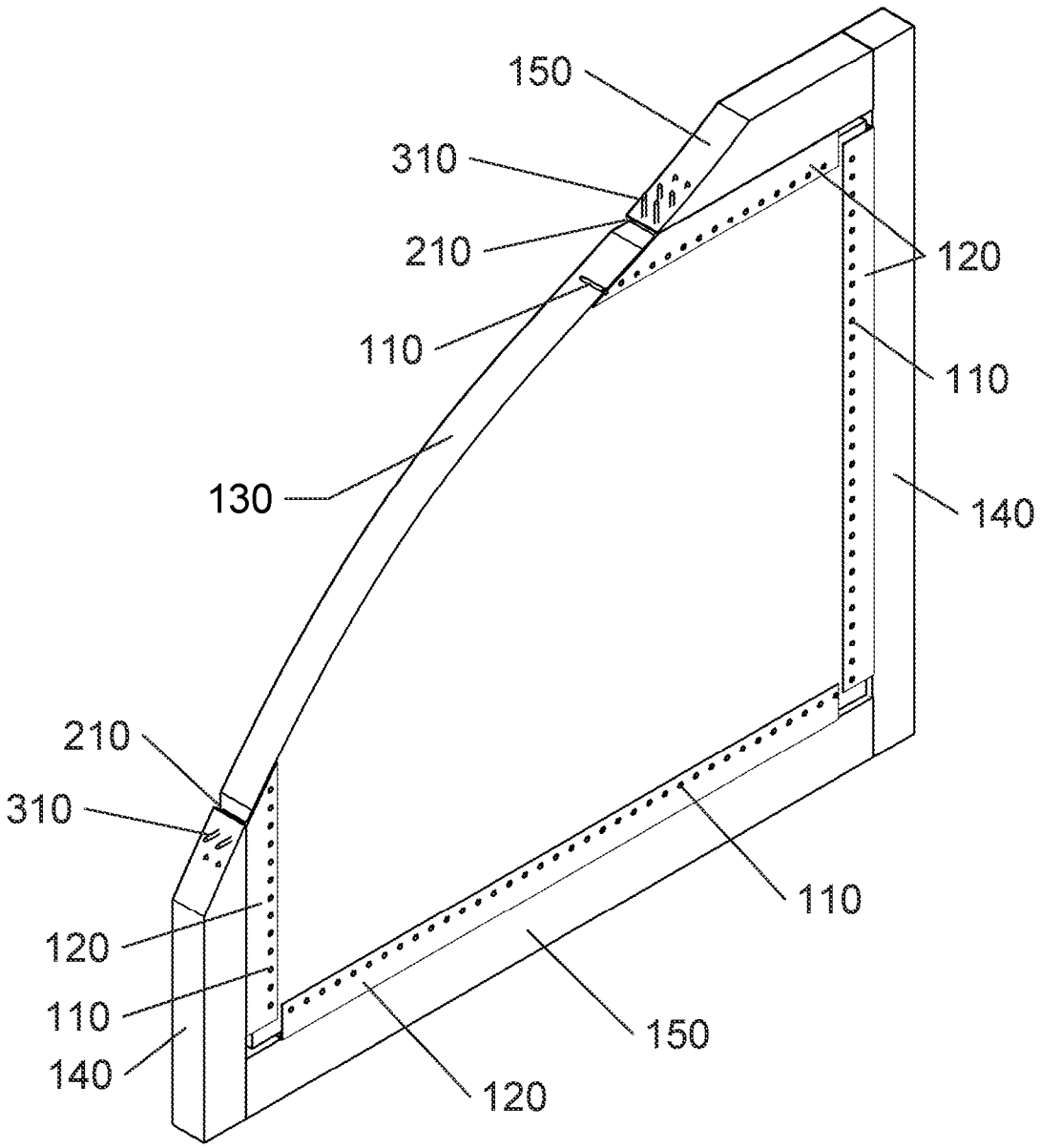
FIG. 1 is an isometric section view of a planar frame with an infilled suspended CLT panel configured in accordance with one embodiment of the present invention.
Figure 2:
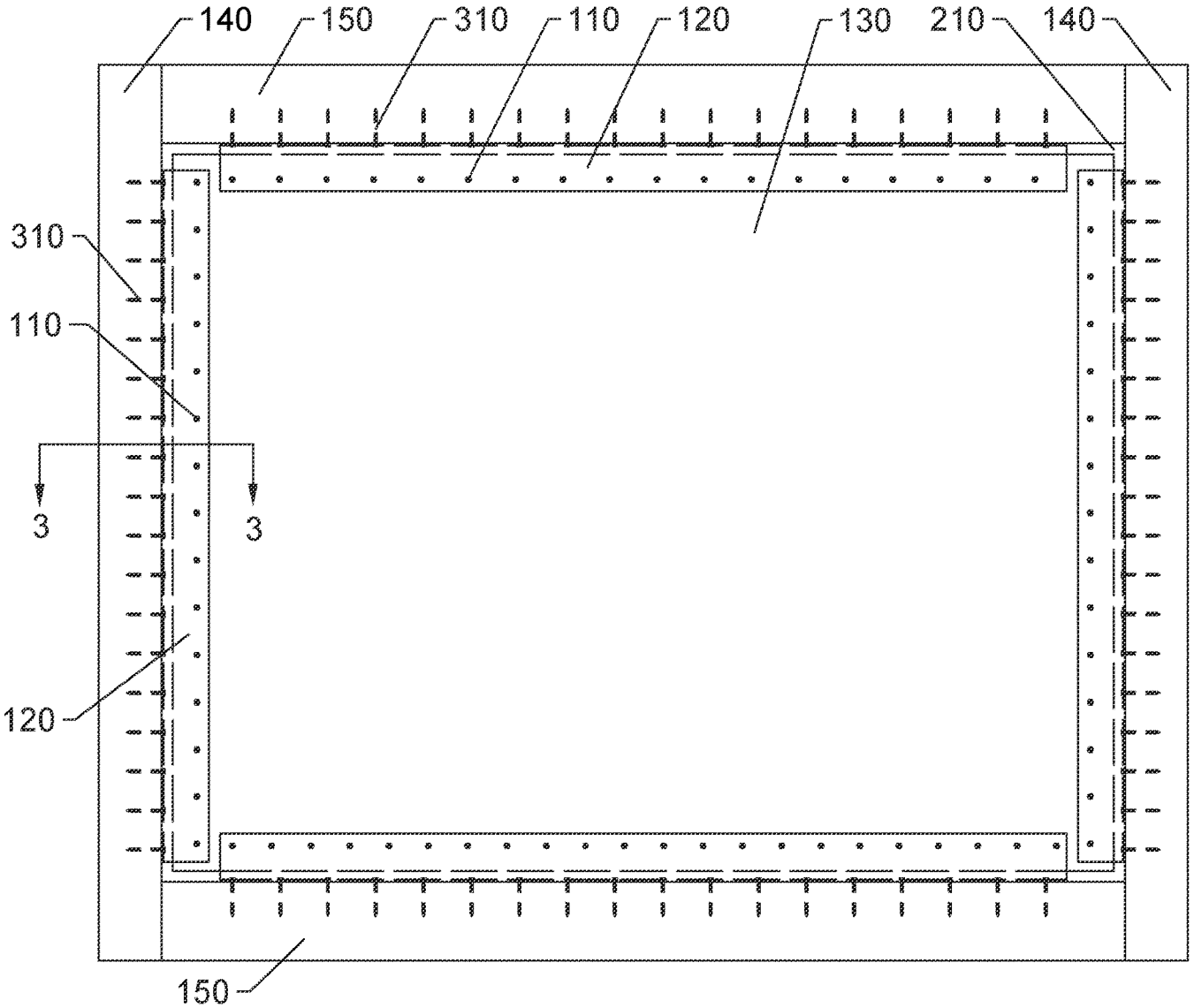
FIG. 2 is an elevation view of a planar frame with an infilled suspended CLT panel configured in accordance with one embodiment of the present invention.

FIGS. 1 and 2 show a wall system according to one embodiment of the present invention which comprises a planar frame including a pair of columns 140 and a pair of beams 150. The materials for the columns 140 and the beams 150 can be glued-laminated timber, steel or concrete. The columns 140 and the beams 150 are connected to each other, and to other adjacent members by conventional connections, which are not shown for clarity. One leg of the steel angles 120 is configured to connect to the columns 140 or the beams 150 on the inside face of the planar frame with at least one fastener 310. The other leg of the steel angles 120 is configured to connect to the edges of the infilled CLT panel 130 with at least one fastener 110 on the flat side of the CLT panel. The width of the one leg of the steel angles 120 is to fit within the member thickness of the columns 140 and the beams 150. The width of the other leg of the steel angles 120 extends over the gap 210 to the edge of the CLT panel 130, so that the at least one fastener 110 on each steel angle 120 can be installed. The details of the steel angle 120 and the associated fasteners 310 and 110 may be seen in FIG. 3. The width of the beams 150 may be wider than that of the columns 140 and the CLT panel 130, depending on the construction details for the floors and other structural components.

Figure 3:
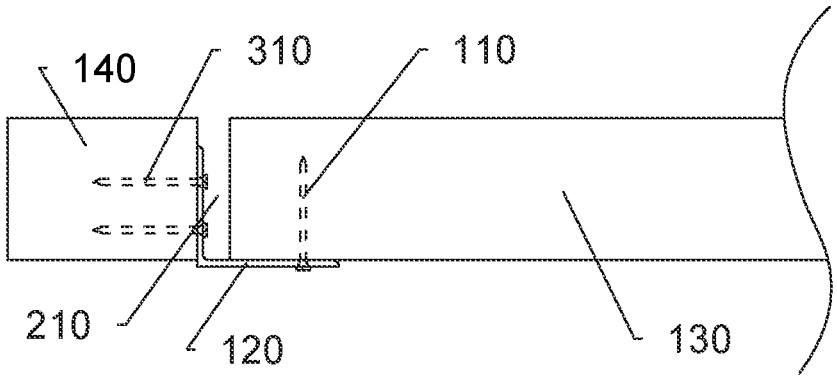
FIG. 3 is a section view taken at line 3-3 of FIG. 2 showing one embodiment of the present invention.

FIGS. 1, 2 and 3 also show that the infilled CLT panel 130 is suspended inside the columns 140 and the beams 150 with the gap 210. The gap 210 refers to the clear distance between the edge of the CLT panel 130 and the head of the at least one fastener 310 as shown in FIG. 3. The gap 210 allows the CLT panel 130 to rotate and translate inside the planar frame. The size of the gap 210 is to be determined by the design prediction of the structural engineer for the wall system, which may range from one half inch to several inches. The steel angles 120 configured to connect the edges of the infilled CLT panel 130 to the columns 140 and the beams 150 with the at least one fastener 310 and the at least one fastener 110 enclose the gap 210 on one side of the wall system except the corners, as shown in FIG. 2. The gap 210 at the corners between the vertical and horizontal steel angles may not be enclosed by the steel angles 120 and thus may be filled with fire-rated elastic materials, such as chalk, sealants and backer rods, depending on fire resistance requirements and other architectural purposes.

The at least one fastener 110 passes through the steel angle 120 and into the infilled CLT panel 130. The at least one fastener 110 may be any dowel-type connector, such as lag screws and self-tapping screws. When the wall system sustains lateral loadings, the at least one fastener 110 bends and deforms relative to the CLT panel 130, which allows the panel 130 to rotate and translate relative to the planar frame members. All of the fasteners 110 work together to be designated as the yielding elements for energy dissipation required for lateral load resistance design. The at least one fastener 310 between the steel angle 120 and each of the planar frame members can be screws, bolts and other connections suitable for the material and the cross-section shape of the columns 140 and the beams 150. The at least one fastener 310 may be designed to be elastic for lateral load resistance design, which does not yield when the wall system sustains lateral loadings. Therefore, the wall system may be designed with yielding to the fasteners 110 and localized bearing to the wood on the infilled CLT panel 130 surrounding the fasteners 110 during major earthquake or wind events. Controlled damages are expected for the yielded fasteners 110 and the CLT panel with locally crushed holes surrounding the fasteners 110 under design events. The extent of the damages can be visibly inspected after these events. The damaged wall system can be repaired by either drilling new holes on the steel angles 120 for new fasteners 110 or by removing all damaged components including the fasteners 110 and the CLT panel 130 and replacing them with new ones, depending on the extent of the damages and the intention of the structural engineer.

FIG. 3 shows the details of the column 140, the steel angle 120, the infilled CLT panel 130, the gap 210, the at least one fastener 310 on the column side and the at least one fastener 110 on the infilled CLT panel side. The detail cutting through the beam 150 is similar except that the beam 150 replaces the column 140.

Figure 4:
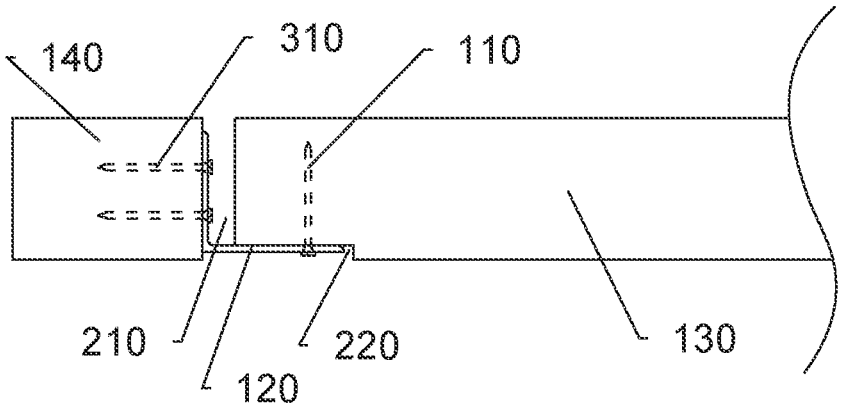
FIG. 4 is a section view taken at line 3-3 of FIG. 2 showing another embodiment of the present invention.

FIG. 4 shows another embodiment of the wall system but has a depressed edge 220 on the infilled CLT panel 130 to receive the steel angle 120 and accommodate the head of the at least one fastener 110. It is obvious that the sizes of the depressed edges 220 depend on the sizes of the steel angle 120 and the length of the head of the at least one fastener 110. This embodiment provides a wall system with a flat finished surface for architectural considerations, such as for gypsum board installation.

Figure 5:
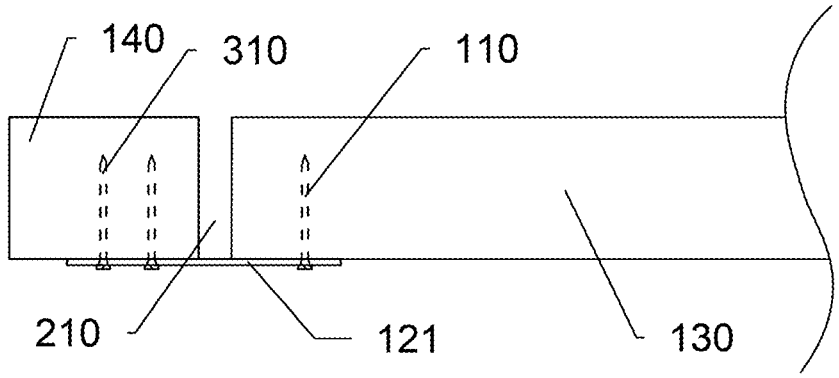
FIG. 5 is a section view alternative to FIG. 3 showing the third embodiment of the present invention.

FIG. 5 illustrates another embodiment of the wall system similar to that shown in FIG. 3, except that the steel plate 121 is used to connect the column 140 and the infilled CLT panel 130. The detail cutting through the beam 150 is similar to FIG. 5 except that the beam 150 replaces the column 140.

Figure 6:
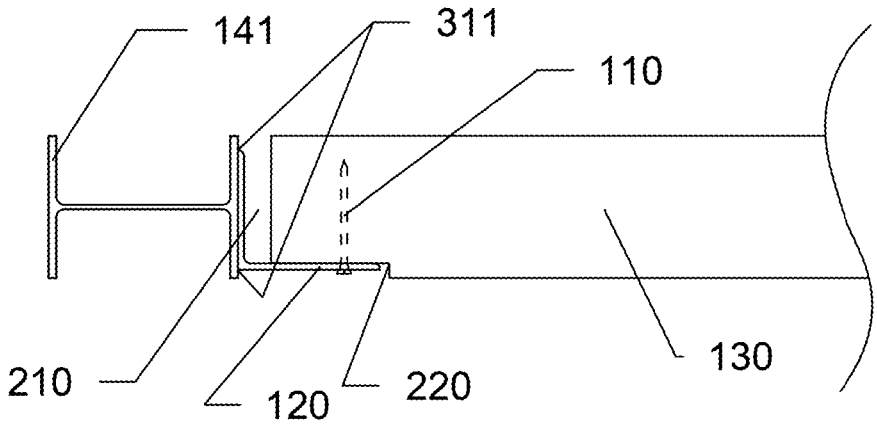
FIG. 6 is a section view alternative to FIG. 4 showing the fourth embodiment of the present invention.

FIG. 6 provides another embodiment of the wall system alternative to FIG. 4, except that a wide flange steel section is used for the column 141. In this case, the at least one fastener 311 can be fillet weld in pairs or bolts. The detail cutting through the beam is similar except that the beam replaces the column 141.

Figure 7:
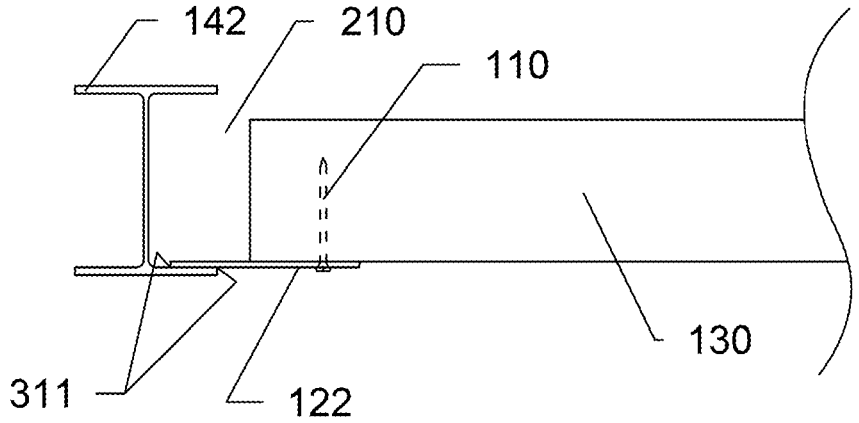
FIG. 7 is a section view alternative to FIG. 6 showing the fifth embodiment of the present invention.

FIG. 7 shows a detail of the wall structure similar to that shown in FIG. 6 except that the flanges of the wide flange steel column 142 face outside of the wall surfaces and the steel plate 122 is used instead of the steel angle. This embodiment chooses the steel column 142 with a clear distance between its flanges to accommodate the thicknesses of the infilled CLT panel 130 and the steel plate 122, as well as the dimension of the at least one fastener 311. Therefore, the width of the gap 210 is measured from the edge of the infilled CLT panel 130 to the web surface of the wide flange steel column 142, which provides relatively large space to allow the infilled CLT panel 130 to rotate and translate. The steel plate 122 is only needed when the wall system is fabricated on a construction site where other structural components including columns and beams have to be installed before the wall panel 130. If the wall system is premanufactured in a shop, the infilled CLT panel 130 may be configured to directly connect to the flange of the steel column 142 with self-tapping screws or lag screws. The detail cutting through the beam is similar to FIG. 7 except that the beam replaces the column 142.

Figure 8:
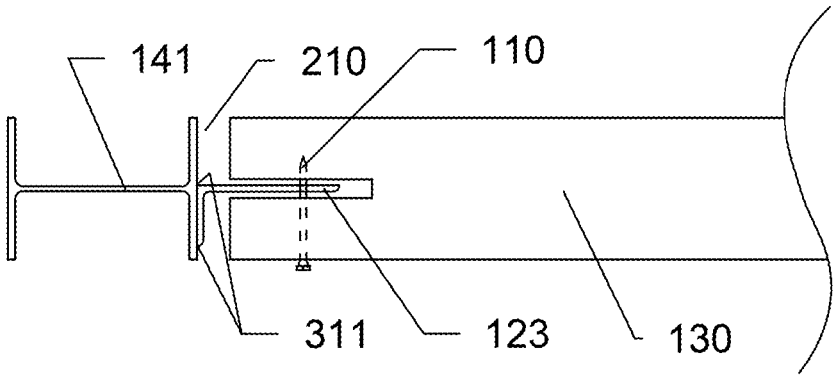
FIG. 8 is a section view alternative to FIG. 6 showing the sixth embodiment of the present invention.

A different arrangement of a wall structure alternative to FIG. 6 is shown in FIG. 8. In this embodiment the steel angle 123 is configured to connect to the slotted edge of the infilled CLT panel 130. In this embodiment, the at least one fastener 110 passes through the infilled CLT panel 130 sandwiching the leg of the steel angle 123 with a space for construction tolerance. The at least one fastener 110 may be self-tapping screws suitable for penetrating into the steel angle. This embodiment of the wall system may be suitable to be pre-manufactured in a shop away from the construction site. The detail cutting through the beam is similar to FIG. 8 except that the beam replaces the column 141.

The wall structures may be used in new construction or existing building restoration for mass timber construction in order to improve their earthquake or wind resistance. In each embodiment, the wall structure develops a ductile shear mechanism under lateral loadings, which is safer than the unfavorable rocking mechanism used in traditional construction for the CLT panels. The wall system permits buildings to be built safely with CLT or other rigid panels in mid-rise and high-rise buildings to greater heights than the current practice.

Various changes may be made to the embodiments shown herein without departing from the scope of the present invention which is limited only by the following claims.

The invention claimed is:

1. A wood wall system comprising:

a pair of columns spaced apart along a horizontal direction, each column having a face in opposed relation to a face of the other column;

a pair of beams spaced apart along a vertical direction, including an upper beam and a lower beam, each beam having a face in opposed relation to a face of the other beam;

a cross-laminated timber panel infilled and suspended inside a planar frame defined by said pair of columns and said pair of beams;

four shaped steel connector members, each shaped steel connector member disposed between a corresponding edge side of the cross-laminated timber panel and a respective member of said columns and said beams;

a first set of fasteners configured to connect a first portion of the shaped steel connector member to the respective column or beam;

a second set of fasteners configured to connect a second portion of said shaped steel connector member to the corresponding edge of the cross-laminated timber panel; and a gap between the face of each of said columns and said beams, and the corresponding edge side of the cross-laminated timber panel, the gap providing clearance to allow the panel to rotate and translate within the planar frame.

2. The wood wall system of claim 1, wherein the second set of fasteners is configured to plastically deform under lateral loadings to dissipate energy.

3. The wood wall system of claim 1, wherein the columns and the beams are made of wood.

4. The wood wall system of claim 1, wherein the columns and the beams are made of concrete.

5. The wood wall system of claim 1, wherein the columns and the beams are made of steel.

6. The wood wall system of claim 1, wherein the shaped steel connector members are steel angles.

7. The wood wall system of claim 1, wherein the shaped steel connector members are bent steel plates.

8. The wood wall system of claim 1, wherein the edge surfaces of the cross-laminated timber panel include recessess configured to receive the shaped steel connector members.

9. The wood wall system of claim 1, wherein the side edges of the cross-laminated timber panel include slots configured to receive the shaped steel connector members.

10. The wood wall system of claim 1, wherein the cross-laminated timber panel is configured to directly connect to the columns and the beams omitting the shaped steel connector members and the second set of fasteners.

* * * * *